US006124577A

United States Patent [19]

Fristedt

[11] Patent Number: 6,124,577

[45] Date of Patent: Sep. 26, 2000

[54] METHOD FOR HEATING A SEAT

[75] Inventor: Tommy Fristedt, Bottnaryd, Sweden

[73] Assignee: Kongsberg Automotive AB, Sweden

[21] Appl. No.: 09/214,538

[22] PCT Filed: Jun. 27, 1997

[86] PCT No.: PCT/SE97/01172

§ 371 Date: Jan. 6, 1999

§ 102(e) Date: Jan. 6, 1999

[87] PCT Pub. No.: WO98/01059

PCT Pub. Date: Jan. 15, 1998

[30] Foreign Application Priority Data

Jul. 9, 1996 [SE] Sweden ..... 9602728

[51] Int. Cl.[7] ..... H05B 1/02

[52] U.S. Cl. ..... 219/497; 219/202; 219/505; 219/494

[58] Field of Search ..... 219/202–207, 219/497, 499, 506, 494, 505; 307/117, 118

[56] References Cited

U.S. PATENT DOCUMENTS

| | | | |
|---|---|---|---|
| 3,227,859 | 1/1966 | Hehl . | |
| 3,946,200 | 3/1976 | Juodikis . | |
| 4,323,763 | 4/1982 | Goldsmith | 219/501 |
| 4,467,183 | 8/1984 | Ishima . | |
| 4,495,405 | 1/1985 | Foster | 219/510 |
| 4,591,699 | 5/1986 | Sato et al. | 219/497 |
| 4,659,910 | 4/1987 | Harrison, Jr. et al. | 219/497 |
| 4,700,046 | 10/1987 | Fristedt . | |
| 4,926,025 | 5/1990 | Wilhelm . | |
| 5,225,663 | 7/1993 | Matsumura et al. . | |
| 5,229,579 | 7/1993 | Ingraham et al. . | |

FOREIGN PATENT DOCUMENTS

| | | |
|---|---|---|
| 2 134 340 | 8/1984 | United Kingdom . |

*Primary Examiner*—Mark Paschall

*Attorney, Agent, or Firm*—Lerner, David, Littenberg, Krumholz & Mentlik, LLP

[57] ABSTRACT

The invention relates to a method for heating a seat comprising a heating element (2) connected to a control unit (1), which is arranged to feed a current (I) through the heating element (2) comprising the detection of the current temperature (T) in connection to the heating element (2) and the control of the temperature (T) by feeding said current (I) through the heating element (2) if said current temperature (T) falls below a predetermined desired temperature ($T_B$). The invention is characterized in that it comprises determining an additional value ($\Delta T_B$) of said desired temperature ($T_B$) and adding said additional value ($\Delta T_B$) to said predetermined desired temperature ($T_B$) in connection with said control by means of the invention. An improved temperature control for a heatable seat is provided, in particular intended for motor vehicles.

15 Claims, 2 Drawing Sheets

METHOD FOR HEATING A SEAT

TECHNICAL FIELD

The present invention relates to a method for heating a seat, according to the preamble of appended claim 1. In particular, the invention can be applied when heating electrically heatable seats in a vehicle.

TECHNICAL BACKGROUND OF THE INVENTION

For reasons of comfort and safety, electrically heatable seats are used in modern vehicles. Both the drivers seat and the other seats can be so arranged that they can be heated by means of special heating elements in the form of electrically conducting wires which are placed in the shape of a heating coil in each seat. Such a heating element is normally placed in the back-rest and in the cushion of each seat when manufacturing the seat. The heating element is furthermore connected to a current feeding unit which delivers current. In this manner, the heating element can be heated to a suitable temperature.

A problem of previously known heating elements is caused by the desire for each seat to have a carefully adjusted temperature on its surface, i.e. on that surface which is in contact with the person sitting in the seat. For this purpose, the temperature of the heating element can be controlled by means of a temperature detector which is arranged in the close vicinity of the heating element, and which is connected to a central control unit. Using the temperature detector and the control unit, the current temperature can be detected. The control unit also comprises current feeding circuits which, for example, can be based on transistor or relay technology, for the feeding of current to the heating element. In this way, the central control unit is arranged to feed a certain current to the heating element until a certain desired value for the temperature is reached. The setting of this desired value can, for example, be done by means of fixed resistances or by means of an adjustable potentiometer, which is adjusted by a person travelling in the vehicle.

U.S. Pat. No. 4,700,046 discloses a control device for a heating element in a vehicle seat. The heating element can be controlled so as reach a certain set temperature.

Using the above described control method, current can be delivered to the heating element until the central control unit indicates that the desired value has been reached. When this happens, feeding of the current stops. This causes the heating element to successively cool down. When the heating element has cooled so that its temperature again falls below the desired value, current feeding to the heating element will be resumed. In this way, the temperature control will continue for as long as the system is operative.

Although this previously known system normally provides a reliable heating and temperature control for a vehicle seat, it has, however, certain drawbacks. One such drawback is due to the fact that the heating element normally is assembled in the seat of the vehicle when it is manufactured, with the heating element being adjusted according to a certain "normal" seat, with a certain given design, upholstery, etc. The seat, in this manner, comprises a heating element for the purpose of heating the surface of the seat to a certain desired temperature. However, when assembling the vehicle the manufacturer might choose to equip the seat in question with, for example, a completely different upholstery, for example a considerably much thicker upholstery than that of said "normal" seat, i.e. an upholstery which differs from that for which the temperature control was originally intended. The temperature value which is detected by the temperature sensor will reach the set desired value when the heating element has reached the desired temperature, but since there is an abnormally thick upholstery on the seat, the temperature on the surface of the seat will be too low. This situation thus causes an undesired deviation of the temperature control.

In a corresponding manner, similar problems can also occur if an abnormally thin upholstery is arranged on the seat, or if the heating element is arranged at a distance from the surface of the seat which deviates from that of the "normal" seat.

SUMMARY OF THE INVENTION

A main object of the present invention is thus to provide an improved heating of a seat in a vehicle, where the above-mentioned drawbacks have been eliminated. This is obtained by means of a method of the initially mentioned kind, the characteristics of which will become evident from appended claim 1.

The invention constitutes a method for heating a seat comprising a heating element connected to a control unit which is arranged to feed a current through the heating element. The invention comprises a detection of current temperature in connection to the heating element, and the control of the temperature by feeding said current through the heating element if said current temperature falls below a predetermined desired temperature. The basic principle of the invention is that it comprises determining an additional value of said desired temperature. This additional value is then added to said predetermined desired temperature in connection with said control. The additional value can be positive or negative. By means of the invention, a compensation is permitted, so that a slightly "too high" (or "too low") value of the desired temperature is utilized. In this way, there is provided a control with individual adjustment to a certain seat design.

Advantageous embodiments will become apparent from the appended dependent claims.

BRIEF DESCRIPTION OF THE DRAWINGS

The invention will in the following be described in connection to an example of a preferred embodiment and the appended drawings, in which.

PREFERRED EMBODIMENTS

Figure 1:
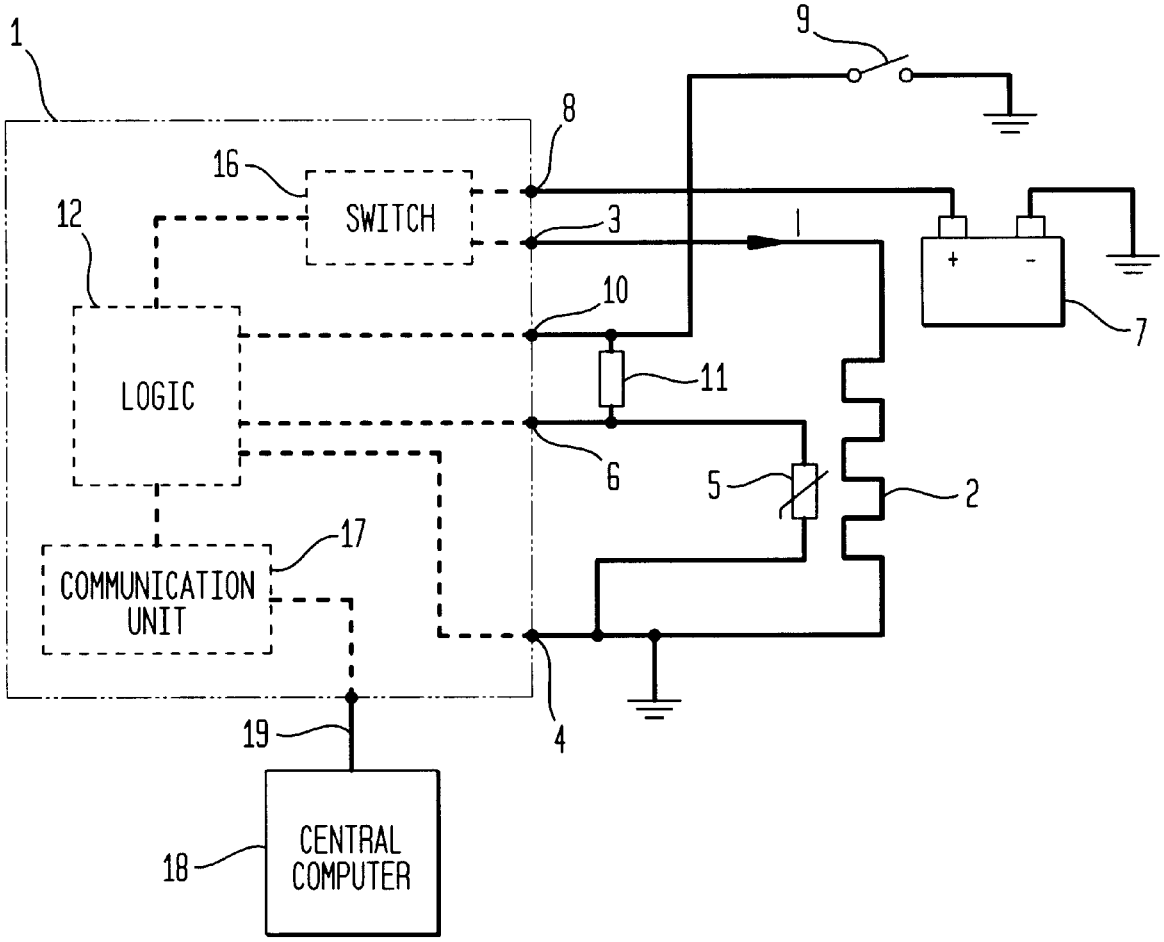
FIG. 1 is a principal circuit diagram which shows a device according to the present invention, FIG. 2 in principle shows a measuring bridge which is utilized when measuring temperature according to the invention, FIG. 3 in principle shows a control sequence according to the present invention, FIG. 4 schematically shows how the transfer of information according to the invention can take place.

FIG. 1 shows the principle of a circuit diagram of a device according to the present invention. According to the preferred embodiment, the invention is intended to be utilized in connection with electrically heatable seats in vehicles. The figure shows, in principle, a control unit 1 whose internal components and connections (which will be described in detail below) are shown with broken lines. The figure does not show all of the components of the control unit 1, but only those parts which are necessary for the understanding of the invention.

The control unit 1 is arranged to feed a certain current I through a heating element 2. This heating element 2 is, as such, of an essentially known kind, and consists of an electrical conductor which with its electrical resistance forms a heating coil. The heating element 2 is arranged inside a (not shown) vehicle seat, preferably in its cushion. In principle, the heating element 2 can also be placed in the back-rest of the vehicle. Although the figure only shows one heating element 2, it is possible to connect several such elements to the control unit 1, for example in the form of a separate heating element for the cushion of the seat and a heating element for the back-rest of the seat. In cases where more than one heating element is used, these can be connected to the control unit, either in parallel or in series.

As shown in FIG. 1, the heating element 2 is connected to the control unit 1 via two connections 3 and 4 respectively, of which the latter connection 4 is also connected to ground via a connection in the body of the vehicle.

In connection to the heating element 2 there is arranged a temperature sensor 5 which is electrically connected to the control unit 1 via the above-mentioned grounded connection 4 and a further connection 6. The temperature sensor 5 preferably consists of a thermistor of the NTC ("Negative temperature coefficient"), which has a temperature dependent resistance $R_T$ which corresponds to the temperature T which is present in the vicinity of the heating element 2. The detection using the temperature sensor 5 will be described in detail below.

There is furthermore a current source 7 connected to the control unit 1 via a further connection 8. The current source 7 preferably consists of the starting battery of the vehicle. The system also comprises an on/off switch 9, which preferably is integrated in the ignition lock of the vehicle (not shown). The switch 9 is connected to a further connection 10 of the control unit 1. The control unit 1 is arranged to be able to be activated and thus permit heating of the heating element 2 when the switch 9 is closed.

A resistor 11 with a predetermined resistance $R_{set}$ is connected between the connection 10, to which the switch 9 is connected, and the not grounded connection 6, to which the temperature detector 5 is connected. As will be described in detail below, the resistor 11 is intended to be utilized in the temperature control of the heating element 2.

In the following, the design and main functions of the control unit 1 will be described. The control unit 1 comprises a logic part 12 which preferably is computer based, but which can also consist of known electronics circuits. The logic part 12 is connected to the above-mentioned connections 4, 6 and 10, and is arranged to detect the current temperature T of the temperature sensor 5. This detection uses a measuring bridge of the kind which is principally shown in FIG. 2. The measuring bridge is of the Wheatstone-bridge kind, and comprises the resistor 11 and the temperature sensor 5, which have the resistances $R_{set}$ and $R_T$, respectively. The measuring bridge furthermore comprises two further resistors 13 and 14 respectively, which preferably are integrated components in the logic part 12, but which are not shown separately in FIG. 1. The resistors 13, 14 have the resistances $R_{13}$, $R_{14}$, respectively.

Figure 2:
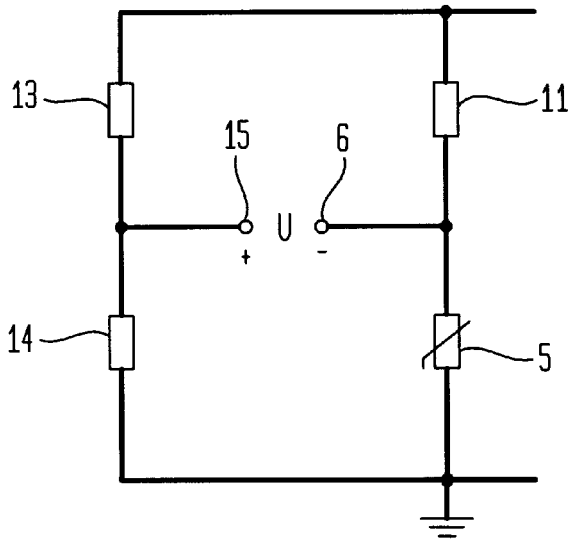

The measuring bridge furthermore comprises (as shown in FIG. 2) two connections, between which there is a certain voltage U. One of these connections corresponds to the connection 6 of FIG. 1, while the other connection 15 is an integrated part of the logic part 12. The logic part 12 is arranged to measure the voltage U when detecting the temperature T of the temperature sensor 5. In case of balance in the measuring bridge, i.e. when the voltage U equals zero, the single unknown resistance, i.e. the resistance $R_T$, of the temperature sensor 5 can be computed using known formulae. In this way, the logic part 12 can compute a value of the resistance RT, which in turn can be converted to a value of the current temperature T.

With renewed reference to FIG. 1, it can be seen that the control unit 1 comprises a switching unit 16 which, depending on signals from the logic part 12, feeds the. current I to the heating element 2. The switching unit 16, which is connected to the above-mentioned connections 3 and 8, is preferably based on a MOSFET-transistor which, as such, is a known semi-conductor component, which efficiently can deliver large currents from the current source 7 to the heating element 2.

The logic part 12 is thus arranged to compute a value of the current temperature T of the temperature sensor 5. If the temperature T falls below a predetermined desired value $T_B$ which corresponds to a certain desired temperature on the surface of the seat of the vehicle, and which in general is determined by the choice of the resistances $R_{13}$, $R_{14}$, $R_{set}$, and by the basic resistance of the thermistor 5, the logic part 12 will control the switching unit 16 to deliver the current I to the heating element 2. When the desired value $T_B$ is reached, the logic part 12 will cut off the current feeding via the switching unit 16 to the heating unit 2.

According to the embodiment, the control unit 2 preferably comprises a communication unit 17, which is arranged to communicate with an external unit in the form of a central computer unit 18. The communication which takes place via a transmission circuit 19 will be described in detail below.

Figure 3:
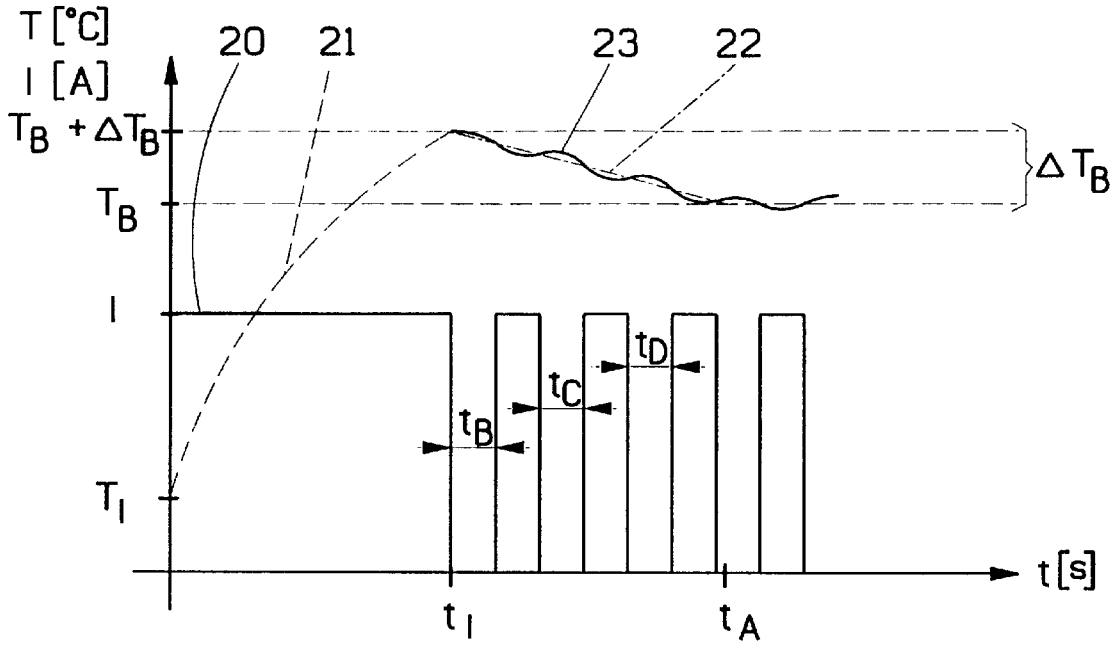

FIG. 3 shows a diagram which in principle explains the sequence of events of the temperature control according to the invention. The system is arranged to heat a vehicle seat, and for this purpose there is a preset desired value $T_B$ for that temperature which is detected by the temperature sensor 5. This desired value $T_B$ can be set in advance tor for example 35° C., and corresponds to the temperature on the surface of a "normal seat", i.e. a previously defined kind of seat with a certain given construction, upholstery, etc.

Due to the above-mentioned problems regarding, for example, differences in seat upholstery of different vehicle manufacturers, there is, according to the invention, a compensation of the desired value in such a way that a certain addition $\Delta T_B$ is added to the original desired value $R_B$. Due to this addition $\Delta T_B$, which is suitable if there is an abnormally thick upholstery or an abnormally long distance from the heating element to the surface of the seat, a compensation takes place, so that the heating element as such is heated to a higher temperature than would have been the case otherwise. For the user who sits on the seat, no difference is perceived, i.e. the user perceives the "normal" temperature which corresponds to the original desired value $T_B$.

When the system is switched on, and the temperature control starts, the logic part 12 will control the switching unit 16 so that the current I is fed to the heating element 2. This is indicated in FIG. 3 by a solid line 20. It is assumed here that the heating element 2 has a certain initial temperature $T_1$ when the heating starts. Since the current I flows through the heating element, its temperature will successively increase, which is indicated with a curve 21 with broken lines in FIG. 3.

Using a conventional control system, the current feeding to the heating element would have continued until the ordinary desired value $T_B$ had been reached, following which the current feeding would have been cut off. As opposed to this, in accordance with the present invention, there is a continued current feeding until the compensated desired value (i.e. $T_B+\Delta T_B$) is reached, following which the feeding of the current I is cut off. If the temperature which is detected by the temperature sensor 5 subsequently falls below the compensated desired value $T_B+\Delta T_B$, the feeding of the current I will be resumed.

Since the seat is successively heated by the heating element, there is also, according to the invention, a "decay" of the additional value $\Delta T_B$. This means that the additional value $\Delta T_B$ successively decreases and approaches zero, which is indicated with lines and dots 22 in FIG. 3. The temperature control will then continue, so that when the measured temperature T is less than the compensated desired value $T_B+\Delta T_B$ (which is indicated in a somewhat exaggerated manner with the curve 23), feeding of the current I to the heating element will take place. Eventually the additional value $\Delta T_B$ will equal zero, following which the control will continue around the initial desired value $T_B$.

According to the embodiment, the additional value $\Delta T_B$ is chosen depending on the length of the initial current pulse, i.e. the period of time $t_1$ which elapses from the start of the control until the current I stops for the first time. We thus have $$\Delta T_B=k_A\times t_1$$

where $k_A$ is a constant which is determined by the seat in question, and which can be positive or negative. To be more exact, the constant kA indicates to which degree the seat used deviates from a "normal" seat, for example due to an abnormally thick upholstery. The constant $k_A$ can also be chosen to a certain value if the user, for reasons of comfort, wishes to have an "abnormally" high initial heating of the seat. The period of time $t_1$, i.e. that period of time during which the feeding of the current I has to take place in order to reach a certain desired value, has a connection to the initial temperature $T_1$, which connection can be decided using experience.

The decay time $t_A$-$t_1$, i.e. that period of time during which the additional value $\Delta T_B$ decreases towards zero, is furthermore decided by the length of the initial period of time $t_1$, according to $$t_A-t_1=k_B\times t_I$$

where $k_B$ is a further constant which is a measure of how much the seat used deviates from the above-mentioned "normal" seat. This can, for example, be caused by the upholstery which is used for the seat. If the seat used has a relatively high initial temperature $T_1$, a relatively short initial time $t_1$ is necessary. This, in turn, causes a relatively short decay time.

As shown in FIG. 3, the feeding of the current I takes place during certain periods, and feeding does not take place during certain intervals $t_B$, $t_C$, $t_D$. According to one variant of the invention, the decay of the addition to the desired value only takes place during these intervals $t_B$, $t_C$, $t_D$. This causes a decay which depends on the initial temperature $T_1$. To be more exact, there is, for example in the case of a very low initial temperature $T_1$, a current feeding during relatively long periods of time, with the intervals $t_B$, $t_C$, $t_D$ then being relatively short. This, in turn, causes a slow decay.

When controlling the temperature of a seat, the desired value $T_B$ is defined in advance. This can be done by choosing the resistors 11, 13, 14, and the basic resistance of the temperature detector 5 (see FIG. 2). The user can, on his own, set a desired value using a potentiometer which belongs to the control unit 1 (not shown), where, for example, the resistance $R_{13}$ (or $R_{11}$ or $R_{14}$) can be adjusted. In a particularly advantageous embodiment, information regarding the desired value $T_B$ can be transferred to the control unit 1 from the central computer unit 18 (see FIG. 1). For this purpose, the control unit 1 comprises a communication unit 17. Its purpose is primarily to ensure that information regarding the desired value $T_B$ for the temperature control of the heating element 2 is transferred to the control unit 1 from the central computer unit 18, which is preferably an already existing computer in the vehicle, which computer for example is utilized for climate control of the vehicle, the ignition system or other similar purposes. The transfer of information takes place via a transmission circuit 19, which preferably consists of an electrical cable.

Figure 4:
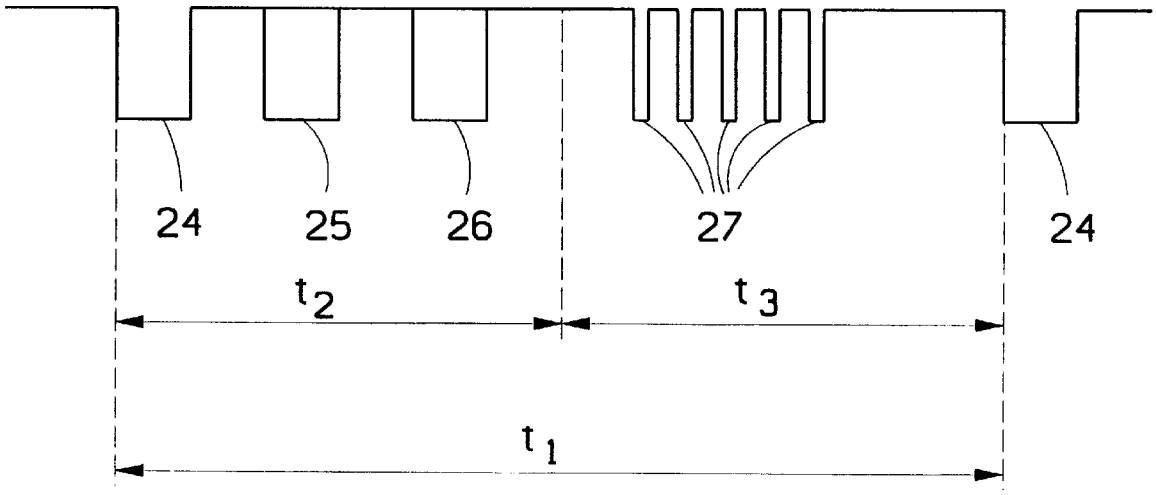

As shown in FIG. 4, the transfer of information between the control unit 1 and the central computer unit 18 is controlled according to a periodic sequence with a certain predetermined period $t_1$. The transfer of information is based on the principle of transferring information which corresponds to a certain set value of the desired temperature $T_B$ from the central computer unit 18 to the control unit 1. Preferably, there is furthermore also a transfer of information in the opposite direction, i.e. from the control unit 1 to the central computer 18. The information which is transmitted from the control unit 1 can, for example, comprise status information. During the total period of time $t_1$, transfer takes place from the control unit 1 during a certain period of time $t_2$, while the transfer to the control unit 1 takes place during another period of time $t_3$.

FIG. 4 thus shows a certain period for the transfer of information. According to the preferred embodiment of the invention, the transfer of information is initiated by a start-bit 24 being transferred from the control unit 1 to the central computer unit 18. For this purpose, the communication unit 17 comprises a (not shown) oscillator circuit which, as such is known, and which is arranged to be able to periodically emit pulses via a connection 19. The central computer unit 18 furthermore comprises a detection circuit (not shown), which, as such is known, for the detection of pulses via the connection 19. The transfer of a start-bit 24 from the control unit 1 initiates a certain period, and indicates that the control unit 1 is ready for function, and that feeding of current to the heating element 2 can take place.

Subsequent to the transfer of the start-bit 24 there is, where used, a transfer of one or two status bits 25, 26, respectively from the control unit 1. According to the embodiment, the first status-bit 25 will be transferred if the heating element 2 is "active", i.e. if there is feeding of current to the heating element 2. In this case, a negative pulse is thus transferred, as indicated in the drawing. The second status-bit 26 will furthermore be transferred (in the form of a negative pulse) if there is a malfunction in the heating element 2. Examples of malfunctions which might occur are that some part of the heating element 2 has been short-circuited, or that the conductor which constitutes the heating element 2 has been broken. The start-bit 24 and the two status-bits 25, 26, can thus be transferred during a time $t_2$ which is defined in advance, and thus deliver information regarding the current status of the heating element 2 to the central computer 18. The transfer of the bits 24, 25, 26 is asynchronous, i.e. the pulses are counted by the central computer unit 18, which thus is the receiving side.

The next phase of the transfer is the transfer of a desired value $T_B$ for temperature control of the heating element 2. This desired value is transferred from the central computer 18 to the control unit 1 during the period of time $t_3$. To be more exact, the transfer takes place via the connection 19 and the communication unit 17 to the logic part 12 (see FIG. 2). During the period of time $t_3$ there is thus a transfer of a number of pulses 27 from the central computer 18. For this purpose, the communication unit 17 is also equipped with a (not shown) detection circuit for counting the number of pulses 27. The number of pulses 27 preferably corresponds to a certain desired value $T_B$ for temperature control of the heating element 2. By way of example, FIG. 3 shows five pulses 27 being transferred. This might correspond to a desired value $T_B$ which, for example, can amount to 35° C., which in turn corresponds to a certain desired temperature on the surface of the seat. If, for example, a desired value of 36° C. is desired, six pulses 27 can for example be transferred.

According to the invention, the central computer unit 18 can also compute the addition $\Delta T_B$ to the desired value and the decay time $t_A$-$t_1$. This can be done using algorithms in the software of the computer unit 18. The information which is transferred by means of the pulses 27 is based on these values regarding the addition $\Delta T_B$ to the desired value and the decay time $t_A$-$t_1$.

A compensated desired value $T_B+\Delta T_B$ can thus be transferred to the logic part 12. With reference to FIGS. 1 and 2, it can now be seen that a given desired value corresponds to a certain expected resistance $R_T$ of the temperature sensor 5. This corresponds to the logic part 12 changing the values of the resistances $R_{13}$ and $R_{14}$, which cause balance in the measuring bridge (see FIG. 2) at the current desired temperature. This can be done by (not shown) switch transistors in the logic part 12 switching between different resistance values in a resistance ladder. The resistance $R_{set}$ is not affected by which desired value $T_B$ is transferred. When the correct temperature has been reached, the resistance $R_T$ of the temperature sensor 5 will be of such a magnitude that balance is reached in the measuring bridge. This corresponds to the desired value (which thus can be a compensated desired value) having been reached.

Since the central computer 18 can deliver information regarding desired values, a correct control of the heating element 2 is obtained regardless of, for example, the upholstery of the seat used. The central computer can, already when manufacturing the vehicle, be provided with information regarding which seat is used, which in turn gives information regarding current desired values ($T_B$, $\Delta T_B$) decay times ($t_A$-$t_1$) and constants ($k_A$, $k_B$).

According to the embodiment, the logic unit 12 is arranged to also detect the case where no pulse 27 at all is transferred during the period of time $t_3$. This is interpreted as a "reset" signal by the logic part 12, and causes any ongoing current feeding to the heating element to cease. The entire logic part 12 is furthermore also set to zero, i.e. flip-flops, switches, registers and counters are set to zero.

For example, error flip-flops which detect short-circuits in the heating element are set to zero. In this way, intermittent malfunctions can be detected. Preferably, the entire system is also shut off, so that any heating ceases if there is reception of too large a number of pulses, i.e. a number of pulses which exceeds the highest desired temperature.

Preferably, the invention utilizes an increase time or "step-in" time, during which the additional value $\Delta T_B$ increases successively from zero to the determined value. In case of the additional value $AT_B$ being negative, there is instead a successive decrease from zero during the step-in time. In a corresponding manner a "step-out" time is also utilized, during which the additional value $\Delta T_B$ successively approaches zero. This can, for example, take place with a predetermined step time subsequent to the heating element having been shut off when the compensated desired value ($T_B+\Delta T_B$) has been reached for the first time, in which case the desired value for the temperature control resumes the initial desired value $T_B$.

It is furthermore an essential object of the invention to eliminate, as far as possible, the thermal pumping effect which can occur in the form of large temperature variations on the surface of the seat used, and which are caused due to current switched on and switched of f, and which also depend on the current distance between the heating element 2 and the temperature sensor 5. For this purpose, the invention can, according to a particular embodiment, utilize so-called proportional band control, which as such is a previously known kind of control, which is utilized here so that, within a certain temperature band, the effect from the heating element is varied proportionally in relation to the temperature within the band. The variation in effect which is carried out can be linearly or non-linearly proportional to the current temperature within the band. At temperatures above the chosen band, the current feeding to the heating element is cut off completely, and at temperatures which are below the chosen band there is a maximal current feeding to the heating element.

The temperature band utilized in the proportional band control is chosen depending on the kind of seat, upholstery, padding and other relevant properties of the materials of the seat.

When transferring information regarding the desired value during said proportional band control, this information can be varied periodically with a predetermined frequency. The time of this period is chosen so that no thermal pumping effect is obtained in the seat. For a normal seat, a frequency is chosen which corresponds to a period which is shorter than about 15 seconds, preferably about 1–2 seconds. The frequency (as well as the effect) can also be varied with the time, or with the length of the "initial pulse" which occurs during heating until the heating element is shut off for the first time, subsequent to a compensated desired value having been reached.

The desired values which are transferred to the control unit 1 during the proportional band control are preferably pulses which vary according to a certain pattern, and with a certain frequency. The temperature band which is chosen for the control is preferably a certain range, which is (symmetrically or asymmetrically) positioned around the change-over point which corresponds to the compensated desired value (i.e. $T_B+\Delta T_B$). The temperature band chosen (i.e. its upper and lower boundary value) can also be made to vary in time when controlled. With a properly chosen pattern and frequency in the proportional band control, in principle no temperature variation is obtained on the surface of the seat.

During proportional band control, the effect can furthermore be varied linearly or non-linearly within the current temperature band. In case of non-linear variation, the degree of non-linearity can be varied with the length of the above-mentioned initial pulse.

In order to limit the temperature variations on the surface of the seat, the invention can alternatively be equipped with effect limits. This would here mean that, subsequent to the first shutting off of the current feeding to the heating element (subsequent to the compensated desired value $T_B+\Delta T_B$ having been reached), the current feeding to the heating element will be shut off and turned on with a relatively high frequency and with a limited effect. In this way, the temperature variations on the surface of the seat can be decreased. During such limiting of the effect, the effect can be varied linearly or non-linearly. The frequency with which the heating element is connected and disconnected can also be varied in time. This frequency can, furthermore, vary depending on the above-mentioned "initial pulse".

As can be understood from the above description, the communication between the central computer unit 17 and the control unit 18 is of the serial kind. This means that only one connection is necessary between the central computer unit 17 and the control unit 1, which in turn reduces the costs in connection with the invention.

The duration of the periods of time $t_1$, $t_2$ and $t_3$, can be varied, and depends on how the oscillator circuit in the communication unit 17 is designed. Preferably a period-length $t_1$ is used (i.e. the time between two start pulses 23) which is of the order of size 600 to 1000 ms; the period of time $t_2$ is about 100–200 ms and the period of time $t_3$ is about 500–800 ms. In this way, the period of time $t_2$ constitutes approximately 10–30% of the total period of time $t_1$, while the period of time $t_3$ constitutes about 70–90% of an entire period. The central computer unit 18 detects the start of a certain period by detecting the start-bit 24. The computer unit 18 can also compute the period of time $t_1$ by measuring the time which elapses between two start-bits 24. By knowing during which part of the period of time $t_1$ information regarding the status of the heating element is expected to be received, the pulses 25 and 26 can be detected. Subsequent to this, a certain number of pulses 27 can be transferred during the period of time $t_3$.

The components of the control unit 1 can, using modern technology, be integrated into one single application specific integrated circuit (ASIC), which provides a very high reliability of the invention. In so doing, the communication unit 17, the logic part 12 and the switching unit 17 are preferably arranged on the same silicon chip. Alternatively, the various circuits can be assembled on separate silicon chips but in the same circuit, i.e. in the same package.

The invention is not limited to that which has been described above: various embodiments are possible within the scope of the claims. The invention can, for example, in principle be utilized to heat other seats than vehicle seats. Different kinds of temperature sensors can furthermore be utilized, for example thermistors with a negative or positive temperature coefficient. An existing temperature sensor in the vehicle can also, in principle, be used. The switching unit 16 can furthermore be based on, for example, MOSFET or relay technology.

The additional value $\Delta T_B$ can furthermore be negative as well as positive.

When heating a seat, a warm seat requires less energy than a cold seat in order to be heated. This means that there is a connection between the value of the period of time $t_1$, the initial temperature $T_1$ and the desired temperature, which can be used for control purposes. The initial time $t_1$ can, for example, give a value of the initial temperature $T_1$.

It should be noted that the invention can also be utilized if no start and status information (i.e. bits 24, 25 and 26) is transferred from the control unit 1. This corresponds to the existence of one-way communication from the central computer unit 18 to the control unit 1. The minimum of information which must be transferred from the central computer unit 18 is a series of pulses 27, which is transferred within a certain interval of time and which indicates a certain desired value for the temperature control. Said desired value furthermore does not need to be transferred in such a way that the number of pulses determines a certain temperature value. Coded signals can instead be transferred, where a certain digital word corresponds to a given temperature value.

If status information is transferred from the control unit 1, the number of status bits does not necessarily need to be two, but can be varied depending on the information which is intended to be transferred from the control unit 1.

According to the invention, the information regarding the current value of the desired value can vary during the temperature control, in particular during the initial pulse which lasts until the heating element is turned off for the first time, subsequent to a compensated desired value having been reached. The length of the initial pulse can be linked to a variety of different parameters in connection with the control, for example the "step-in" time, the "step-out" time, and the size and frequency of the proportional band control. The period of time during which heating with the heating element takes place (or, alternatively, the time when heating does not take place) can also be linked to the corresponding parameters.

The current desired value which is used in the control can, according to an alternative embodiment, follow a predetermined relationship which varies in time. In this way, a compensation of the desired characteristics on the surface of the seat which is used is enabled.

It is furthermore not necessary to use communication with an external unit 18 in order to provide the compensated and dynamically varying desired value $T_B+\Delta T_B$. If an external computer unit is not utilized, this information can, for example, be determined using an RC-circuit in the logic part 12 whose time constant in controlled by the current feeding pulses.

Finally the connection 19 can consist of an electrical cable, an optical cable or a radio connection.

What is claimed is:

1. Method for heating a seat comprising a heating element (2) connected to a control unit (1), which is arranged to feed a current (I) through the heating element (2), comprising:

detection of the current temperature (T) of the heating element (2), control of the temperature (T) by feeding said current (I) through the heating element (2) if said current temperature (T) falls below a predetermined desired temperature ($T_B$), the control of the temperature (T) comprising:

determining an additional value ($\Delta T_B$) for said desired temperature ($T_B$), the magnitude of said additional value ($\Delta T_B$) being dependent on the operation or the design of said seat, and adding said additional value ($\Delta T_B$) to said predetermined desired temperature ($T_B$) in connection with said control for adjusting the temperature (T) of the heating element (2) during said heating of the seat so that the temperature of the surface of the seat corresponds to said predetermined desired temperature ($T_B$).

2. Method according to claim 1, wherein information (27) regarding said desired temperature ($T_B$) or said additional value ($\Delta T_B$) is transferred to said control unit (1) from an external unit (18).

3. Method according to claim 2, wherein information (25, 26) regarding the status of said heating element is also transferred from said control unit (1) to said external unit (18).

4. Method according to claims 2 or 3, wherein said information is transferred serially via a transmission channel (19) between the control unit (1) and the external unit (18).

5. Method according to claims 2 or 3, wherein said information is transferred in the form of a series of pulses, the number of which directly corresponds to a value of said desired temperature ($T_B$) and/or said additional value ($\Delta T_B$).

6. Method according to claims 2 or 3 wherein said method comprises a proportional band control, with said transferred information (27) being chosen so that the effect from the heating element (2) is varied periodically and proportionally to the current temperature (T) if the current temperature (T) is within a predetermined interval.

7. Method according to claim 2 or 3, further comprising switching, with the feeding of the current (I) to the heating element (2) being switched on and off with a predetermined frequency and effect, subsequent to a predetermined desired temperature ($T_B+\Delta T_B$) having been reached.

8. Method according to claim 1, wherein said additional value ($\Delta T_B$) is determined by means of an RC-circuit in the control unit (1).

9. Method according to claim 1, wherein said control is initiated by current (I) being fed through said heating element (2) until a value which corresponds to the sum of said additional value ($\Delta T_B$) and said desired temperature ($T_B$) is reached, subsequent to which the current feeding ceases, and with the additional value ($\Delta T_B$) being calculated proportionally according to the initial time ($t_1$) which has elapsed until the current feeding has ceased.

10. Method according to claim 1, wherein said additional value ($\Delta T_B$) is reduced to zero during a decay time ($t_A$-$t_1$).

11. Method according to claim 10, wherein said decay time ($t_A$-$t_1$) is decided depending on the initial time ($t_1$) which has elapsed until the current feeding has ceased after a value which corresponds to the sum of said additional value ($\Delta T_B$) and said desired temperature ($T_B$) is reached during control being initiated by current (I) being fed through said heating element (2).

12. Method according to claim 10, wherein said decay time ($t_A$-$t_1$) is decided in proportion to a value ($k_B$) which constitutes a measure which corresponds to the design of said seat.

13. Method according to claim 10, wherein said reduction of the additional value ($\Delta T_B$) takes place during periods of time ($t_B$, $t_C$, $t_D$) during which said current feeding does not take place.

14. Method according to claim 1 wherein said additional value ($\Delta T_B$) is increased, or decreased, from zero to its chosen value ($\Delta T_B$) during a predetermined increase time.

15. Method according to claim 1 wherein said additional value ($\Delta T_B$) is determined proportionally to a value ($k_A$) which constitutes a measure corresponding to the design of said seat.

* * * * *

UNITED STATES PATENT AND TRADEMARK OFFICE

CERTIFICATE OF CORRECTION

PATENT NO. : 6,124,577
DATED : September 26, 2000
INVENTOR(S) : Fristedt

It is certified that error appears in the above-identified patent and that said Letters Patent is hereby corrected as shown below:

Title page,
Please cancel the "Abstract" presently on file and insert new Abstract:
-- A method for heating a seat having a heating element so that the temperature at a surface of the seat corresponds to a predetermined desired temperature. The method includes detecting the temperature of the heating element, and controlling the temperature by feeding an electric current through the heating element if the detected temperature falls below a predetermined desired temperature. The control of the temperature includes determining an additional value for the desired temperature, the magnitude of the additional value being dependent on the operation or the design of the seat. The additional value is added to the predetermined desired temperature for adjusting the temperature of the heating element so that the temperature of the surface of the seat corresponds to the predetermined desired temperature. --

Column 1,
Line 12, "drivers" should read -- driver's --.
Line 43, after "as" insert -- to --.

Column 4,
Line 5, "RT" should read -- $R_T$ --.
Line 38, "tor" should read -- to --.

Column 5,
Line 30, -"kA" should read -- $K_A$ --.

Column 7,
Line 63, "$AT_B$" should read -- $\Delta TB$ --.

Column 8,
Line 10, "of f" should read -- off --.

Column 10,
Line 27, "in" should read -- is --.
Line 33, cancel "(2)".
Line 33, cancel "(1)".
Line 34, cancel "(I)".
Line 34, cancel "(2)".
Line 35, cancel "(T)".
Line 36, cancel "(2)".
Line 37, cancel "(T)".
Line 37, cancel "(I)".

UNITED STATES PATENT AND TRADEMARK OFFICE

CERTIFICATE OF CORRECTION

PATENT NO. : 6,124,577
DATED : September 26, 2000
INVENTOR(S) : Fristedt

It is certified that error appears in the above-identified patent and that said Letters Patent is hereby corrected as shown below:

Column 10,
Line 38, cancel "(2)".
Line 39, cancel "(T)".
Line 40, cancel "($T_B$)".
Line 40, cancel "(T)".
Line 42, cancel "($\Delta T_B$)".
Line 43, "($T_B$)".
Line 44, cancel "($\Delta T_B$)".
Line 46, cancel "($\Delta T_B$)".
Line 47, cancel "($T_B$)".
Line 48, cancel "(T)".
Line 49, cancel "(2)".
Line 52, cancel "($T_B$)".
Line 53, cancel "(27)".
Line 54, cancel "($T_B$)".
Line 55, cancel "($\Delta T_B$)".
Line 55, cancel "(1)".
Line 56, cancel "(18)".
Line 57, cancel "(25,".
Line 58, cancel "26)".
Line 59, cancel "(1)".
Line 60, cancel "(18)".
Line 61, "claims" should read -- claim --.
Line 63, cancel "(19)".
Line 63, cancel "(1)".
Line 63, cancel "(18)".
Line 64, "claims" should read -- claim --.
Line 67, cancel "($T_B$)".
Line 67, cancel "($\Delta T_B$)".

Column 11,
Line 1, "claims" should read -- claim --.
Line 3, cancel "(27)".
Line 4, cancel "(2)".
Line 5, cancel "(T)" (both occurrences).
Line 8, cancel "with".
Line 8, cancel "(I)".
Line 9, cancel "(2)".
Line 11, cancel "($T_B+\Delta T_B$)".
Line 13, cancel "($\Delta T_B$)".
Line 14, cancel "(1)".
Line 16, cancel "(I)".

UNITED STATES PATENT AND TRADEMARK OFFICE

CERTIFICATE OF CORRECTION

PATENT NO. : 6,124,577
DATED : September 26, 2000
INVENTOR(S) : Fristedt

It is certified that error appears in the above-identified patent and that said Letters Patent is hereby corrected as shown below:

Column 10,
Line 17, cancel "(2)".

Column 11,
Line 18, cancel "($\Delta T_B$)".
Line 19, cancel "($T_B$)".
Line 20, cancel "($\Delta T_B$)".
Line 21, cancel "($t_1$)".
Line 24, cancel "($\Delta T_B$)".
Line 4, cancel "(tA-t1)".

Column 12,
Line 2, cancel "($t_A$-$t_1$)".
Line 2, cancel "($t_1$)".
Line 5, cancel "($\Delta T_B$)".
Line 5, cancel "($T_B$)".
Line 6, cancel "(I)".
Line 7, cancel "(2)".
Line 9, cancel "($t_A$-$t_1$)".
Line 9, cancel "($k_B$)".
Line 13, cancel "($\Delta T_B$)".
Line 14, cancel "($t_{B0}$, $t_C$, $t_D$)".
Line 17, cancel "($\Delta T_B$)".
Line 18, cancel "($\Delta T_B$)".
Line 20, cancel "($\Delta T_B$)".
Line 20, cancel "($k_A$)".

Signed and Sealed this

Twenty-third Day of October, 2001

*Attest:*

Nicholas P. Godici

NICHOLAS P. GODICI
*Acting Director of the United States Patent and Trademark Office*

*Attesting Officer*